US008550091B2

(12) United States Patent
Yomtov et al.

(10) Patent No.: US 8,550,091 B2
(45) Date of Patent: Oct. 8, 2013

(54) ELECTRICALLY HEATED WATER PIPE SMOKING DEVICE

(75) Inventors: Amir Yomtov, South Boca Raton, FL (US); Solon L. Kandel, Boca Raton, FL (US); Jacob Elefant, Boca Raton, FL (US)

(73) Assignee: Kannel Management, LLC, Boca Raton, FL (US)

( * ) Notice: Subject to any disclaimer, the term of this patent is extended or adjusted under 35 U.S.C. 154(b) by 506 days.

(21) Appl. No.: 12/276,435

(22) Filed: Nov. 24, 2008

(65) Prior Publication Data

US 2010/0126516 A1 May 27, 2010

(51) Int. Cl.
*A24F 11/00* (2006.01)
*A24F 1/30* (2006.01)

(52) U.S. Cl.
USPC ..... 131/328; 131/173; 131/194

(58) Field of Classification Search
USPC ..... 131/173, 194, 328
See application file for complete search history.

(56) References Cited

U.S. PATENT DOCUMENTS

| | | | | |
|---|---|---|---|---|
| 3,889,690 | A * | 6/1975 | Guarnieri | 131/185 |
| 2002/0144992 | A1* | 10/2002 | Vieira | 219/486 |
| 2006/0086364 | A1* | 4/2006 | Liu | 131/173 |
| 2007/0056599 | A1* | 3/2007 | Zoumut | 131/329 |
| 2007/0086365 | A1* | 4/2007 | Chen et al. | 370/260 |
| 2007/0280652 | A1* | 12/2007 | Williams | 392/386 |
| 2009/0084391 | A1* | 4/2009 | Krupp | 131/173 |

* cited by examiner

*Primary Examiner* — Richard Crispino
*Assistant Examiner* — Dionne Walls Mayes
(74) *Attorney, Agent, or Firm* — Dekel Patent Ltd.; David Klein

(57) ABSTRACT

A water pipe including a bowl for placing therein a smoking substance, a tube that fluidly connects the bowl to a base member, at least one hose connection port, in fluid communication with the base member, for connecting with at least one flexible hose, an electric heating element disposed in the bowl for heating the smoking substance, the electric heating element being shaped as an inner periphery of the bowl, and a controller in electrical communication with the electric heating element, the controller controlling electrical power to the electric heating element for heating the smoking substance to a temperature that vaporizes volatile aromatic components of the smoking substance without substantially causing combustion of the smoking substance.

10 Claims, 3 Drawing Sheets

ELECTRICALLY HEATED WATER PIPE SMOKING DEVICE

FIELD OF THE INVENTION

The present invention relates generally to water pipe smoking devices, such as hookahs or narghiles, and particularly to an electrically heated water pipe.

BACKGROUND OF THE INVENTION

Water pipes are well known and come in a variety of forms, including hookahs and narghiles. The term "water pipe" will be used to encompass all such smoking devices, but the terms water pipe and hookah will both be used interchangeably for convenience in the description that follows.

The hookah or water pipe has been used for centuries to smoke both plain and flavored tobaccos, mixtures of various aromatic herbs and spices, or mixtures of both. Typically a hookah has a bowl in which tobacco is placed, the bowl being mounted on top of a reservoir structure. The interior of the reservoir is partially filled with water. Extending downward from the bowl into the reservoir is a tubular hollow stem, with its lowermost extremity immersed in the water. The interior portion of the reservoir structure (i.e., the air space) above the level of the water forms a chamber into which smoke may be collected. One or more flexible hoses extend outward from this smoke collection portion of the reservoir or from a neck base extending from and in fluid communication with the reservoir.

Inhaling through a flexible hose, a smoker causes smoke to be drawn from the bowl down the stem, passing the smoke through the water in the lower portion of the reservoir. Passing upwards through the water in the form of bubbles, smoke gradually fills the smoke collection portion of the reservoir, and when sufficient smoke has been collected, passes on through the flexible hose to the smoker. By drawing the smoke through a water reservoir, the smoke is filtered and cooled.

This basic functionality is shared by virtually all traditional hookahs, which generally differ only in size, shape, style and number of hoses, although the means used to burn the tobacco may also differ. Some use a lighted coal placed in or above the bowl with the tobacco to provide a heat source for burning the tobacco. Others may require an ignition source such as a match or butane lighter to be placed near the top of the bowl to begin burning the tobacco. However, all traditional hookahs use combustion as the method of producing smoke, thus also producing all the undesirable combustion by-products in the smoke. Use of water to filter and cool the smoke may reduce some of the undesirable smoke components, but some, such as carbon monoxide, heavy metal and potentially hazardous chemicals created by placing the aluminum foil that is used to cover the tobacco beneath the burning charcoal, cannot be removed in this manner.

Combustion has traditionally been the only technology available for production of smoke. However, electric power has allowed development of a variety of alternatives to combustion for use by smokers. These typically generate a sufficient amount of heat to vaporize volatile aromatic components of the tobacco without actually burning the tobacco, in this way avoiding production of undesirable combustion by-products such as carbon monoxide present in smoke. However, according to U.S. Pat. No. 7,287,530 to Stuart, despite the existence of these and other technologies, all hookahs and the vast majority of smoking appliances still rely on the use of combustion as the means to produce smoke for inhalation, and make no provision for the use of any alternate technology.

SUMMARY OF THE INVENTION

The present invention seeks to provide an improved electrically heated water pipe, as is described in detail further herein below. The water pipe of the present invention vaporizes volatile aromatic components of the tobacco without actually burning the tobacco, thereby avoiding production of undesirable combustion by-products.

It is noted that the hookah device, in its various forms, can be used with or without water (without water as a vaporizer, such as for aromatherapy).

There is thus provided in accordance with an embodiment of the present invention a water pipe including a bowl for placing therein a smoking substance, a tube that fluidly connects the bowl to a base member, at least one hose connection port, in fluid communication with the base member, for connecting with at least one flexible hose, an electric heating element disposed in the bowl for heating the smoking substance, the electric heating element being shaped as an inner periphery of the bowl, and a controller in electrical communication with the electric heating element, the controller controlling electrical power to the electric heating element for heating the smoking substance to a temperature that vaporizes volatile aromatic components of the smoking substance without substantially causing combustion of the smoking substance.

In accordance with a non-limiting embodiment of the present invention, the electric heating element is near or above a top portion of the smoking substance, and may include a glass encased circular carbon fiber or similar glass heating element.

The water pipe may further include a neck base mounted on top of the base member, and may further include a stem member mounted between the bowl and the neck base. The at least one hose connection port may extend from the neck base.

In accordance with a non-limiting embodiment of the present invention, the controller cooperates with a temperature sensor placed in the bowl operative to measure a temperature of the smoking substance. The controller may include settings preset for different smoking substances for vaporizing aromatic components of the different smoking substances without reaching combustion thereof. A display may be provided that indicates if a temperature is safe or not safe for only vaporizing volatile aromatic components of the smoking substance without undesirable combustion by-products.

In accordance with a non-limiting embodiment of the present invention, a chemical sensor is placed in the bowl for sensing production of undesirable combustion by-products, the sensor communicating with the controller in a closed control loop, wherein if the sensor senses an undesirable combustion by-product, the controller lowers heat given off by the electric heating element so as to stop production of the undesirable combustion by-product and only vaporize volatile aromatic components of the smoking substance.

There is also provided in accordance with an embodiment of the present invention a method for converting a hookah into an electric power hookah, the method including taking a hookah intended for use with a non-electric heating source for heating a smoking substance, and installing in the hookah an electric heating element in a position suitable for heating the smoking substance to a temperature that vaporizes volatile aromatic components of the smoking substance without substantially causing combustion of the smoking substance.

In accordance with an embodiment of the present invention the electric heating element is provided in a power hookah conversion kit that includes the electric heating element housed in a bowl including a lid. The electric heating element may be assembled to a heat resistant handle.

The power hookah conversion kit may includes a plug-in power cord receptacle mounted at an end of the handle and electrically connected to the heating element, a universal power cord of a universal adaptor connected to the receptacle, and a temperature controller connected to the power cord.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
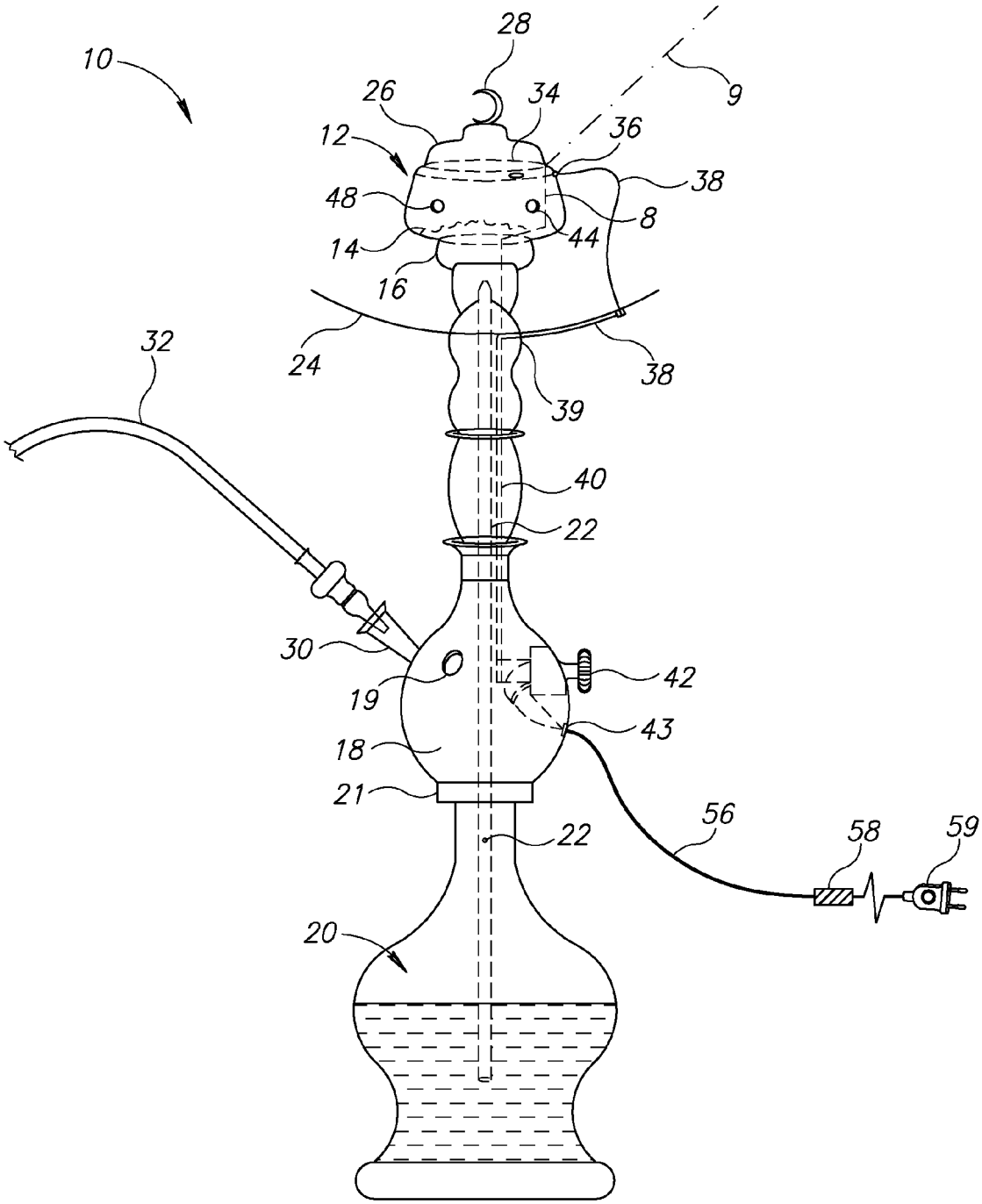
FIG. 1 is a simplified illustration of a water pipe, constructed and operative in accordance with an embodiment of the present invention.

Reference is now made to FIG. 1, which illustrates a water pipe 10, constructed and operative in accordance with a non-limiting embodiment of the present invention.

Water pipe 10 includes a bowl 12 in which a smoking substance 14 is placed. Smoking substance 14 may include, without limitation, plain and flavored tobaccos, mixtures of various aromatic herbs and spices, or mixtures of both. Bowl 12 may be made of, without limitation, glass, such as thermal shock resistant borosilicate glass (PYREX) or tempered soda lime glass. Bowl 12 is mounted on top of a stem member 16, which in turn is mounted on top of a neck base 18, which is mounted on top of a base member 20. Base member 20 may be made of, without limitation, glass, but not necessarily the same glass as bowl 12 (base member 20 does not require the extreme temperature properties as bowl 12).

Stem member 16 may come in different lengths or may be eliminated altogether, to form different size hookahs, such as for floor use or table top use.

A neck tube 22 is disposed through stem member 16 and neck base 18 and reaches into base member 20, thereby fluidly connecting bowl 12 all the way down to base member 20. Neck tube 22 may be made of, without limitation, metal, glass or silicone tubing. As in traditional hookahs, a tray or plate 24 is placed below bowl 12 near the top or at the top of stem member 16, for catching ashes or burnt tobacco and the like. A lid 26 may be placed on top of bowl 12. Lid 26 may have knob 28 or similar structure for grasping, preferably made of a thermally insulated material so as to prevent accidental burning of the fingers.

Neck base 18 may have one or more hose connection ports 30, as in traditional hookahs, for connecting with flexible hose(s) 32. Neck base 18 may be screwed on or otherwise connected to base member 20 with an air-tight seal 21 (e.g., O-ring or grommet). Bowl 12 may also be connected to stem member 16 with an air-tight seal (e.g., O-ring or grommet). Neck base 18 may include an air valve 19 for regulating the air pressure inside water pipe 10, thereby regulating the sucking power required by the smoker to draw vapors from the air space in base member 20 through flexible hose 32.

As in traditional hookahs, base member 20 is partially filled with water and the lowermost extremity of tube 22 is immersed in the water. The air space above the level of the water forms a chamber into which smoke may be collected. Inhaling through flexible hose 32, a smoker causes smoke to be drawn from bowl 12 down tube 22, thereby passing the smoke through the water in the lower portion of base member 20. The smoke bubbles upwards through the water, gradually fills the air space above the water, passes up the neck base 18 and eventually passes on through flexible hose 32 to the smoker who draws the smoke through the mouthpiece of flexible hose 32.

Water pipe 10 differs from traditional hookahs in several aspects, such as the manner of heating the smoking substance 14. In the present invention, smoking substance 14 is heated by an electric heating element 34 disposed in bowl 12. In prior art hookahs, lighted coals are placed in or above the bowl to burn the smoking substance. In contrast, in accordance with an embodiment of the present invention, electric heating element 34 is arcuate in shape and is placed along an inner circumference of bowl 12 near or above a top portion of smoking substance 14. In other words, electric heating element 34 is shaped as an inner periphery of bowl 12 (if bowl 12 is circular, elliptical or prismatic, heating element 34 is respectively circular, elliptical or prismatic). The electric heating element 34 may be attached to the inner periphery of bowl 12 or may be spaced there from. It is noted that in the present invention the electrical heating element takes up significantly less space than the coals and there is no need for an electrical heating element that spans the entire area over the smoking substance 14. For example, without limitation, electric heating element 34 may be a circular carbon fiber heating element, rated at 300/400 W, 110/240 V, encased in bowl 12 or encased in thermal and electrical insulation and attached (e.g., bonded) to the interior of bowl 12. In general, electric heating element is shaped as an inner periphery of said bowl An electrical wire connector 36 may be mounted on bowl 12 for electrically connecting wires thereto for supplying electricity to power electric heating element 34. In one embodiment of the present invention, shown in FIG. 1, one or more electrical wires 38 are connected to connector 36 and pass through to the underside of tray 24, and from there via a sealed connector 39 pass through a wiring tube 40 down to a controller 42. Controller 42 may be a potentiometer (e.g., 110/240 V) with an easily read display (analog or digital) and power cord connection (for connecting to mains). Controller 42 controls the amount of electrical power to heat smoking substance 14, and may cooperate with a temperature sensor 44 (e.g., thermocouple wire, probe or thermistor) placed in bowl 12 that measures the temperature of smoking substance 14.

Figure 2:
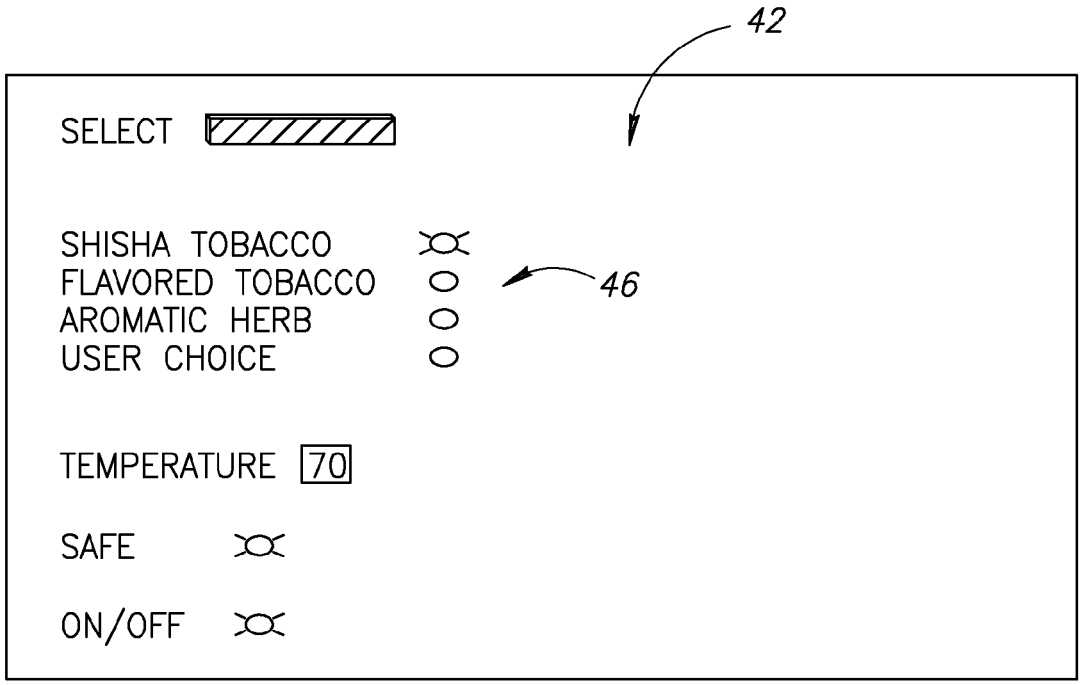
FIG. 2 is a simplified illustration of a controller that controls the amount of electrical power to heat the smoking substance in the water pipe, in accordance with an embodiment of the present invention.

As mentioned above, water pipe 10 vaporizes volatile aromatic components of the smoking substance 14 without actually burning the smoking substance 14, so as to prevent production of undesirable combustion by-products. Accordingly, as seen in FIG. 2, controller 42 may have settings 46 preset for different smoking substances so that the user does not have to guess the correct temperature to vaporize the aromatic components without reaching combustion. The display may display the current temperature of the substance (as sensed by temperature sensor 44), and/or may indicate (such as with a green light and red light) if the temperature is safe (green light) or not safe (red light) for only vaporizing the volatile aromatic components of smoking substance 14 without undesirable combustion by-products.

Of course, the display may include other lights of any suitable colors, for indicating ON/OFF status and any other pertinent information.

Reference is made again to FIG. 1. In accordance with another embodiment, one or more chemical sensors 48 may be optionally placed in bowl 12 for sensing production of undesirable combustion by-products, such as carbon monoxide. Sensor 48 communicates with controller 42 in a closed control loop, wherein if sensor 48 senses an undesirable combustion by-product, controller 42 lowers the heating energy given off by electric heating element 34 so as to stop production of the undesirable combustion by-product and only vaporize the volatile aromatic components of smoking substance 14.

As described above, controller 42 and the electrical wiring 38 from electric heating element 34 to temperature controller 42 and a power cord receptacle 43 are all on water pipe 10 except for the external universal power cord 56. The electrical wiring 38 is internal inside water pipe 10, except for the connection from bowl 12 to the underside of tray 24. Alternatively, even the connection from bowl 12 to the underside of tray 24 could be internal with the wires running inside bowl 12 straight down to the underside of tray 24, as indicated by dashed lines 8. The electrical power source can be obtained via an electric plug connected to an outlet or via portable power pack, for example.

In accordance with another embodiment, shown in dashed-dot line 9, the electrical wiring 38 to bowl 12 is completely external. The wires or a mains power cord are connected directly to electrical wire connector 36. It is noted that batteries or battery packs are also contemplated as possible sources for electrical power.

Figure 3:
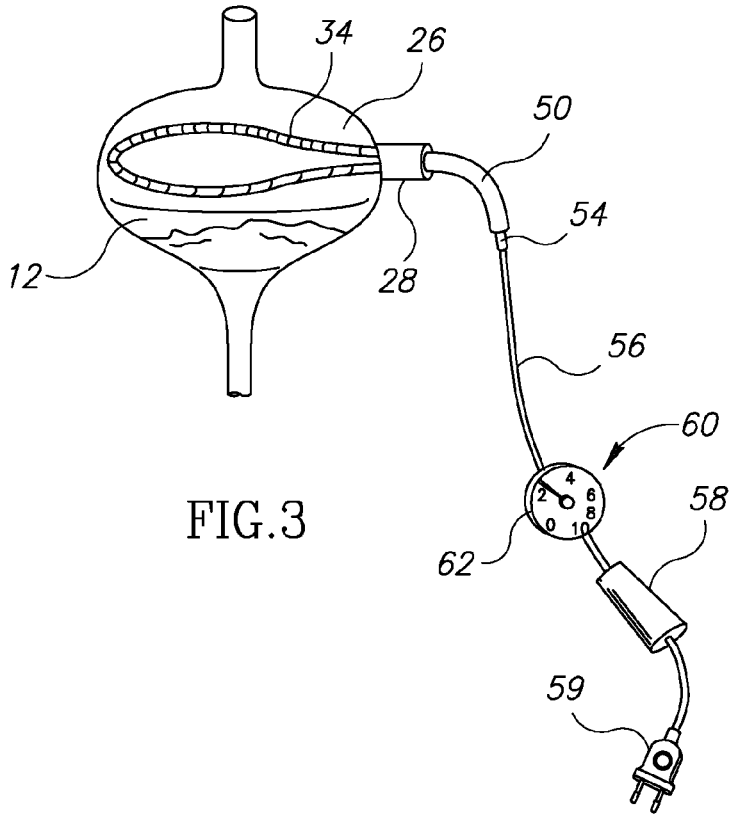
FIG. 3 is a simplified illustration of a power hookah conversion kit, constructed and operative in accordance with an embodiment of the present invention.

Reference is now made to FIG. 3. In accordance with another embodiment, components of water pipe 10 may be used as a "power hookah conversion kit", that is, a kit for converting an existing water hookah to a power water hookah.

The power hookah conversion kit may include, for example, without limitation, the electric heating element 34 (e.g., a glass carbon fiber circular or similar glass heating element/lamp) housed in a bowl 12, including cover lid 26. The electric heating element 34 may be mounted about half an inch (12.7 mm) from the bottom of bowl 12, but the invention is not limited to this distance. The electric heating element 34 may be assembled to a heat resistant handle 50 via an easy replacement socket 52 mounted on the outside of bowl 12. A plug-in power cord receptacle 54 may be mounted at the end of handle 50 and electrically connected to the heating element 34. A universal power cord 56 of a universal adaptor 58 (100/240 V, for example) may be connected to receptacle 54. A wall plug or car cigarette lighter plug 59 is also provided. The power cord 56 may be connected to a temperature controller 60, which has a power indicator 62 (e.g., a plurality of power indicator LEDs) and/or a knob with a dial markings for temperature settings (with or without digital temperature display module). Temperature controller 60 can provide some or all of the functions of controller 42 of FIG. 1. A power control switch box is another option for controlling the power to electric heating element 34.

It is noted that in all the embodiments of the invention, changing the temperature of vaporization can be accomplished not by turning a dial and the like, but rather by changing the distance of the heating element from the smoking substance, such as by moving the heating element towards or away from the smoking substance by turning a knob and the like.

Any other suitable universal external power supply may alternatively be used. Traditional hookah hose connectors and silicone tubing covered with a traditional hookah hose cover may be provided in the kit.

Figure 4:
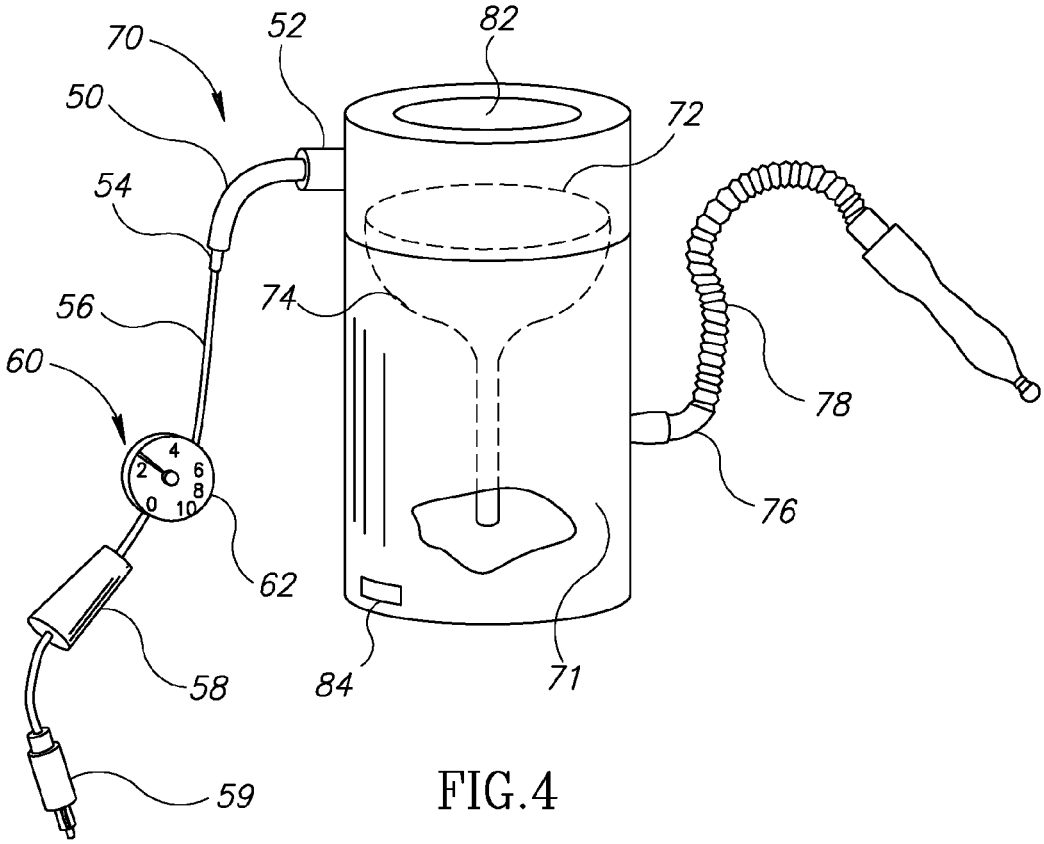
FIG. 4 is a simplified illustration of a portable water pipe, constructed and operative in accordance with another embodiment of the present invention.

Reference is now made to FIG. 4, which illustrates a portable or traveling water pipe 70, constructed and operative in accordance with another embodiment of the present invention.

Water pipe 70 has a base member 71 which may be made from or made to resemble a standard coffee mug or coffee urn and the like. For portability and traveling purposes, base member 71 may fit in a standard cup holder. Alternatively, a coffee mug and the like may be retrofitted for use as a "traveling power hookah to go" by using the power hookah conversion kit described above (of course, with suitable sized components), and with a hole drilled in the side for the flexible hose connection.

Water pipe 70 includes a bowl 72 in which smoking substance 14 is placed, as described above. Bowl 72 may be made similar to bowl 12 described above. Alternatively, bowl 72 may be made from PYREX glass or clay (or earthenware or porcelain or the like). An internal combination cylinder bowl holder and neck tube 74 may be used to hold bowl 72 in place and serve as the neck tube for fluidly connecting bowl 72 down to base member 71 where the water is placed. Base member 71 has a flexible hose connection 76 for connecting thereto a flexible hose 78 (preferably water resistant), similarly as described above.

The bowl 72 is capped by a lid 80, which may be made of glass or metal (e.g., stainless steel) including electric heating element 82 (similar to electric heating element 34). The electric heating element may be, for example, a 12 volt circular glass heating element connected through a socket 52 and a heat resistant handle and a power cord with temperature controller as described and depicted in the power hookah conversion kit FIG. 3. The power travel/hookah to go can use a standard 12 volt cigarette lighter adaptor plug 59 and also can be used in a 110/240 volt system with the use of a universal wall plug receptacle cord to be attached to adaptor 58 as shown in FIG. 3. In addition the power travel hookah can be used as a portable water pipe with the use of a standard 12 volt rechargeable battery power pack to be plugged in universal power cord adaptor 58.

Optionally an LED colored light 84 may be provided on base member 71, although for the power hookah coffee mug no LED is deemed necessary.

Smoking substance 14 is heated as before with heating element 34. In this embodiment, heating element 34 may be a 120 volt ceramic heater, but can be other heaters, such as a 12 volt circular element that fits in bowl 72 and which is attached to a heat resistant handle that houses the power cord receptacle, which may have a built-in 12 Volt, 50/70 watt temperature controller switch with marked dialed knob and LED power indicator, all as described above for the power hookah conversion kit.

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable sub combination.

What is claimed is:

1. A method for converting a vessel into an electric power hookah, the method comprising:

installing in or on a vessel a bowl and an electric heating element in a position suitable for heating a smoking substance placed in said bowl to a temperature that vaporizes volatile aromatic components of the smoking substance without substantially causing combustion of the smoking substance, wherein said electric heating element is shaped as an inner periphery of said bowl and is placed inside said bowl along said interior periphery of said bowl above a top portion of said smoking substance;

installing in said vessel a tube that fluidly connects said bowl to a base member; and attaching a flexible hose to be in fluid communication with said base member, said flexible hose being adapted for drawing therethrough aromatic components of the smoking substance that have been vaporized, and attaching said electrical heating element to said interior periphery of said bowl.

2. The method according to claim 1, wherein said electric heating element is provided in a power hookah conversion kit that comprises said electric heating element housed in said bowl including a lid.

3. The method according to claim 2, wherein said electric heating element is assembled to a heat resistant handle.

4. The method according to claim 3, wherein said power hookah conversion kit comprises:

a plug-in power cord receptacle mounted at an end of said handle and electrically connected to the heating element;

a universal power cord of a universal adaptor connected to said receptacle; and a temperature controller connected to said power cord.

5. The method according to claim 1, comprising changing the temperature that vaporizes volatile aromatic components of the smoking substance by changing a distance of said electric heating element from said smoking substance.

6. The method according to claim 1, comprising placing said electrical heating element so that said electrical heating element does not span an entire area over said smoking substance.

7. The method according to claim 1, further comprising spacing said electrical heating element from said interior periphery of said bowl.

8. The method according to claim 1, further comprising sensing and displaying a temperature of said smoking substance.

9. The method according to claim 8, further comprising indicating if said temperature is safe or not safe for only vaporizing the volatile aromatic components of said smoking substance without undesirable combustion by-products.

10. The method according to claim 1, further comprising sensing production of undesirable combustion by-products, and if an undesirable combustion by-product is sensed, further comprising reducing heat given off by said electric heating element so as to stop production of the undesirable combustion by-product and only vaporize volatile aromatic components of said smoking substance.

* * * * *